US006505917B1

(12) United States Patent
Gutierrez et al.

(10) Patent No.: US 6,505,917 B1
(45) Date of Patent: Jan. 14, 2003

(54) ELECTRODE PATTERNS FOR PIEZO-ELECTRIC INK JET PRINTER

(75) Inventors: Jean-Marie Gutierrez, Southbury, CT (US); Hongsheng Zhang, San Diego, CA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/905,760

(22) Filed: Jul. 13, 2001

(51) Int. Cl.[7] ..... B41J 2/045
(52) U.S. Cl. ..... 347/68
(58) Field of Search ..... 347/68, 71, 72, 347/58

(56) References Cited

U.S. PATENT DOCUMENTS

| | | | | |
|---|---|---|---|---|
| 5,153,477 | A | | 10/1992 | Jomura et al. |
| 5,381,171 | A | | 1/1995 | Hosono et al. |
| 5,444,471 | A | | 8/1995 | Usui et al. |
| 5,446,485 | A | | 8/1995 | Usui et al. |
| 5,600,357 | A | | 2/1997 | Usui et al. |
| 5,894,317 | A | | 4/1999 | Usui et al. |
| 5,910,809 | A | | 6/1999 | Usui et al. |
| 5,912,526 | A | | 6/1999 | Okawa et al. |
| 5,983,471 | A | * | 11/1999 | Osawa ..... 29/25.35 |
| 6,039,440 | A | | 3/2000 | Osawa et al. |
| 6,053,601 | A | | 4/2000 | Watanabe et al. |
| 6,074,047 | A | | 6/2000 | Hotomi et al. |

FOREIGN PATENT DOCUMENTS

| | | |
|---|---|---|
| EP | 1 070 589 | 1/2001 |

* cited by examiner

*Primary Examiner*—Thinh Nguyen
(74) *Attorney, Agent, or Firm*—Lisa M. Soltis; Mark W. Croll; Donald J. Breh

(57) ABSTRACT

A piezo-electric printhead is formed from a first piezo-electric actuator disposed parallel to a second piezo-electric actuator. The first and second piezo-electric actuators have a shared inner electrode disposed between them, a first control electrode disposed on an outside surface of the first piezo-electric actuator and a second control electrode disposed on an outside surface of the second piezo-electric actuator. The actuators are formed from a block having a piezo-electric layer disposed on a ceramic base, in which the piezo-electric layer has two parallel, distinct electrode patterns embedded therein in the form of a metal paste.

18 Claims, 9 Drawing Sheets

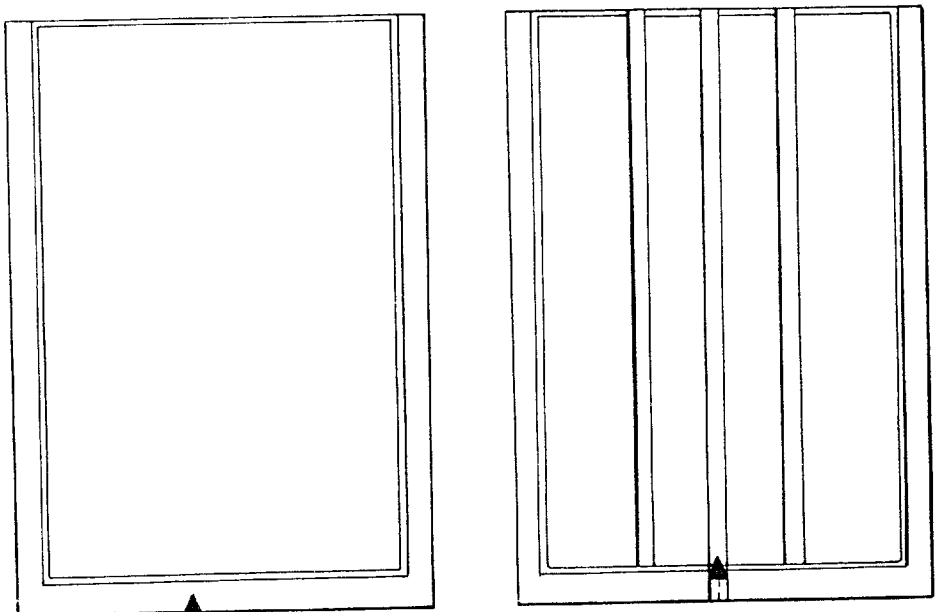
FIG. 1A
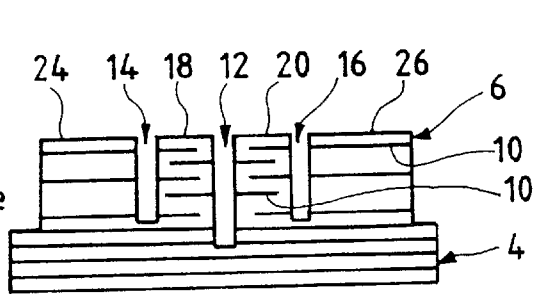
FIG. 2A
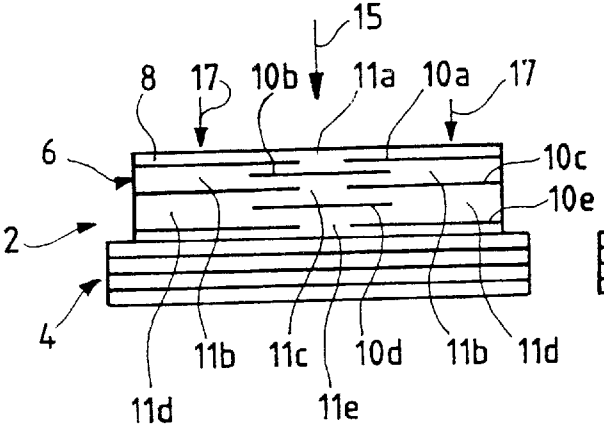
FIG. 1B
FIG. 2B

ELECTRODE PATTERNS FOR PIEZO-ELECTRIC INK JET PRINTER

BACKGROUND OF THE INVENTION

The present invention relates to ink jet printing, and more particularly to novel electrode patterns for piezo-electric ink jet print heads.

When an electric field is applied to a piezo-electric material or composite, it changes its dimensions. In piezo-electric drop-on-demand ink jet printing, actuation can occur when a thin wall of an ink chamber is deformed through the use of a piezo-electric transducer or actuator causing a change in pressure in the chamber and leading to the formation and ejection of a drop out of a small orifice hole.

One of the difficulties to date in achieving high resolution piezo-electric printheads, is how to limit the size of printhead. Printhead size is directly related to the size of the piezo-electric transducer. To achieve sufficient ink displacement, relatively large transducers are needed. This, however, is in contrast with the necessity for large numbers of transducers in a relatively small area to achieve the required print quality and density (i.e., resolution).

Another difficulty is in designing print actuators that provide sufficient displacement So eject an ink drop at a reasonable application voltage.

One approach that has been employed in an effort to address the foregoing difficulties is by attaching one end of a piezo-electric rod or other structure to a thin deformable membrane making up a wall of the ink chamber. When an electrical signal is applied, the piezo-electric material is energized in "direct mode" causing it to expand and push on the membrane creating a volume change in the chamber. This volume change in the chamber results in the formation of an ink drop which is then ejected through the orifice hole and onto a page.

There are two principal types of direct modes. The first is commonly referred to as "D31 mode." In D31 mode, the direction of deformation of the piezo-electric transducer is perpendicular to the polarization of the piezo-electric material and to the applied electric field. In general, piezo-electric transducers that operate in D31 mode are arranged parallel to each other in an array, with electrodes placed between each individual transducer. While the displacement per unit voltage applied for each individual transducer is relatively large, the total displacement of the ink chamber membrane is limited to the amount of displacement of each individual transducer. In other words, the displacements of the individual transducers are parallel to each other and there is no cumulative displacement. As a result, a large number of individual transducer elements and a correspondingly large printhead are necessary to achieve high resolution printing.

An alternate direct mode is commonly referred to as "D33 mode." In D33 mode, the direction of deformation of the piezo-electric transducer is parallel to both the polarization of the piezo-electric material and electric field applied. In D33 mode it is possible to stack piezo-electric layers with a cumulative displacement.

One difficulty with D33 mode is how to precisely control individual print actuators to effect drop on demand printing. To control the actuators, it is necessary to connect them to a control signal. Where the actuator electrodes reside on an exposed external surface, access is relatively simple. However, to achieve high resolution it is necessary to arrange multiple actuators in a closely spaced array. In such an arrangement it often is difficult to access the internal electrodes. Thus, where even two parallel columns of actuators are used there are at least two internal electrode surfaces that are not readily accessible.

Accordingly, there is a need for a piezo-electric printhead that provides high resolution printing in a small or compact assembly. Desirably, such a piezo-electric printhead is configured with electrodes that permit ready access (i.e., connection) for controlling the printhead operation.

There is a further need for a method for making a piezo-electric printhead that facilitates readily fabricating such a printhead in which a large number of transducers are contained within a limited area such that print high print resolution requirements are readily achieved.

SUMMARY OF THE INVENTION

A piezo-electric printhead includes a first piezo-electric actuator disposed parallel to a second piezo-electric actuator, the first and second actuators having a shared inner electrode disposed between them. A first control electrode is disposed on an outside surface of the first piezo-electric actuator and a second control electrode disposed on an outside surface of the second piezo-electric actuator.

The piezo-electric actuator is fabricated from a single ceramic block, having a ceramic base disposed beneath a multilayer structure with alternating piezo-electric and conductive layers. A positively charged electrode is disposed on a first face of the piezo-electric actuator and a negatively charged electrode is disposed on a second face of the piezo-electric actuator. In one embodiment, control circuitry is connected to the electrodes through conductive vias in the base of the block.

The present invention also contemplates a method of manufacturing a piezo-electric printhead. Such a method includes the steps of providing a block having a piezo-electric layer disposed on a ceramic base, with the piezo-electric layer having electrodes embedded therein in the form of a metal paste. The piezo-electric layer is diced to form a first column of piezo-electric actuators, and a second column of piezo-electric actuators disposed adjacent to the first column in a parallel array. Each column has an internal face and an outer face. A shared electrode is formed on the internal face and an oppositely charged electrode is formed on the outer face, with the shared electrode acting as a ground and the oppositely charged electrodes connected to a control circuit. An outer surface of the piezo-electric layer is plated with conductive material. The ceramic block is cut into an array of piezo-electric actuators.

In a preferred embodiment, the conductive layers are disposed in at least two distinct, alternating patterns. A first pattern is disposed to define at least a first gap at a first longitudinal position. A second pattern is disposed to form at least a second gap at a second longitudinal position different from the first longitudinal position. The conductive layers of the first pattern are electrically connected to the first control electrode and the conductive layers of the second pattern are electrically connected to the second control electrode.

The present invention also contemplates a method of fabricating a piezo-electric printhead that includes the steps of providing a ceramic block having a ceramic base disposed beneath a layered piezo-electric structure with a conductive layers embedded between successive piezo-electric layers and cutting the piezo-electric structure to expose the conductive layers. The piezo-electric structure is plated to form a first electrode and a second electrode in contact with the conductive layers. The method includes dicing the piezo-electric structure to form an array of individual actuators and cutting conductive vias into the base of the block. Control circuitry is connected to the electrodes through the conductive vias.

In a preferred method, a first dice is formed in the piezo-electric layer to a first predetermined depth and a second dice is formed dice in the piezo-electric layer parallel to the first dice. The second dice is formed to a second predetermined depth different from the first predetermined depth. The first and second dice define a column of piezo-electric actuators. The actuator column has an internal face and an outer face, with a shared electrode on the internal face and an oppositely charged electrode on the outer face.

The method further includes plating an outer surface of the piezo-electric layer with conductive material and cutting the ceramic block transverse to the dicing to a third predetermined depth between the first and second predetermined depths forming an array of piezo-electric actuators.

The present invention further contemplates a method of controlling a piezo-electric actuator that includes the steps of connecting control circuitry to a piezo-electric actuator through a conductive via disposed beneath the actuator and supplying a signal from the control circuitry to the piezo-electric actuator. The signal travels through the conductive via to a control electrode in contact with the actuator.

Other features and advantages of the present invention will be apparent to those skilled in the art from the following detailed description, the accompanying drawings and the appended claims.

BRIEF DESCRIPTION OF THE DRAWINGS

The benefits and advantages of the present invention will become more readily apparent to those of ordinary skill in the relevant art after reviewing the following detailed description and accompanying drawings, wherein:

FIG. 1 illustrates a top view and a cross-sectional view of the ceramic starting block used to form a piezo-electric printhead and a method for making the printhead in accordance with the principles of the present invention;

FIG. 2 illustrates a top view and a cross-sectional view of the ceramic block after the first cutting steps;

DETAILED DESCRIPTION OF THE INVENTION

Figure 4A:
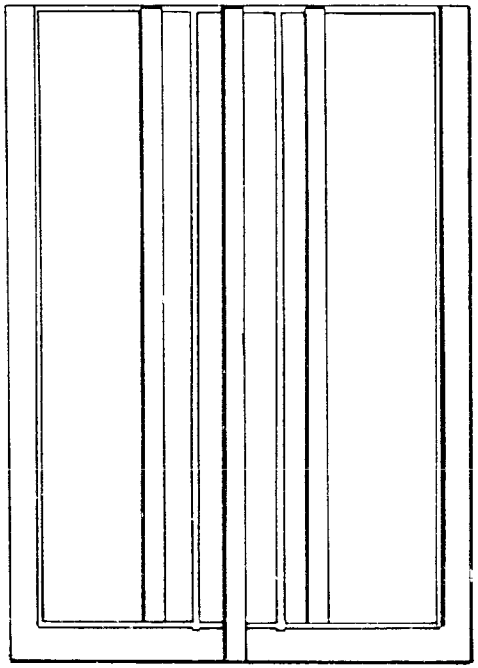
FIG. 4 illustrates a top view and a cross-sectional view of the ceramic block after shallow cuts have been made in the actuation columns to separate the electrodes.

While the present invention is susceptible to various embodiments, there is shown in the drawings and will hereinafter be described specific embodiments and methods with the understanding that the present disclosure is to be considered an exemplification of the invention and is not intended to limit the invention to the specific embodiments and methods illustrated and described.

It is to be further understood that the title of this section of the specification, namely, "Detailed Description of the Invention" relates to a requirement of the United States Patent and Trademark Office, and is not intended to, does not imply, nor should be inferred to limit the subject matter disclosed herein and the scope of the invention.

In one embodiment, the invention is directed to a piezo-electric printhead having an electrode and contact arrangement that allows for a D33 direct mode matrix.

Referring first to FIG. 1, there is shown a single block ceramic structure 2. The structure 2 has a base 4 of ceramic material that is disposed beneath a multilayer structure 6. The multilayer structure 6 is formed from a piezo-electric material 8 imbedded with conductive layers 10 in the form of a conductive paste that is fired at high temperature. Those skilled in the art will recognize and appreciate the forming of such a structure and the temperatures used for firing the structure.

Figure 8:
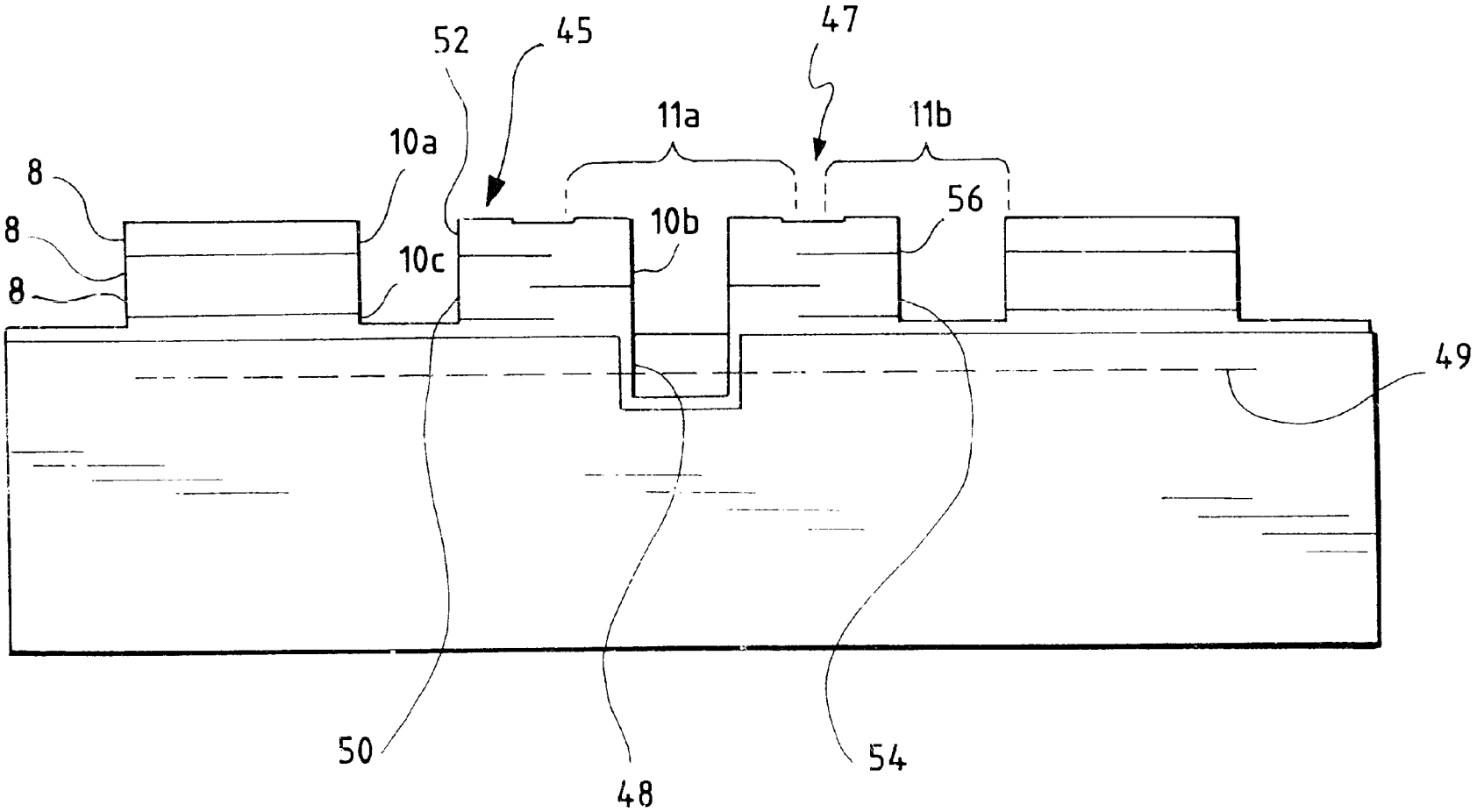
FIG. 8 is a cross-sectional illustration of the printhead.
Figure 11:
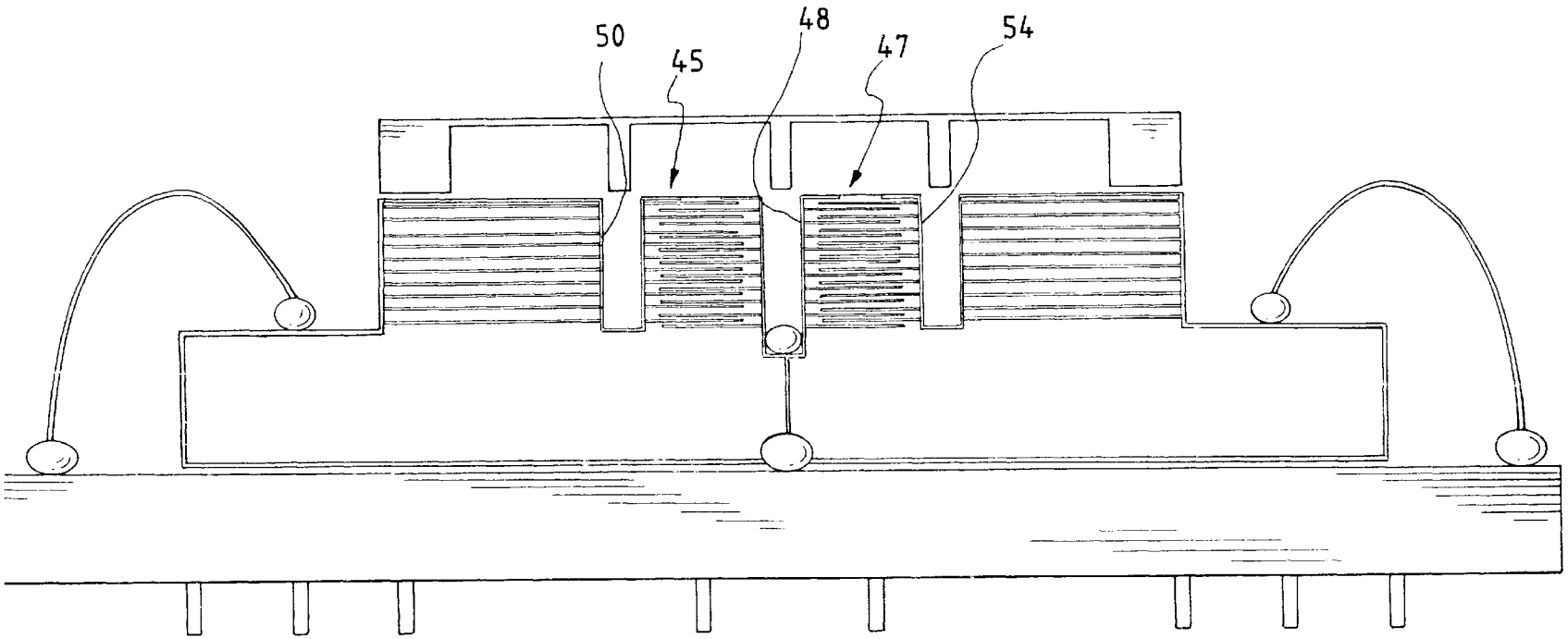
FIG. 11 is a cross-sectional schematic illustration of an embodiment of the electrode and connection pattern, in which electrode access is from a side of the piezo-electric actuator.
Figure 12:
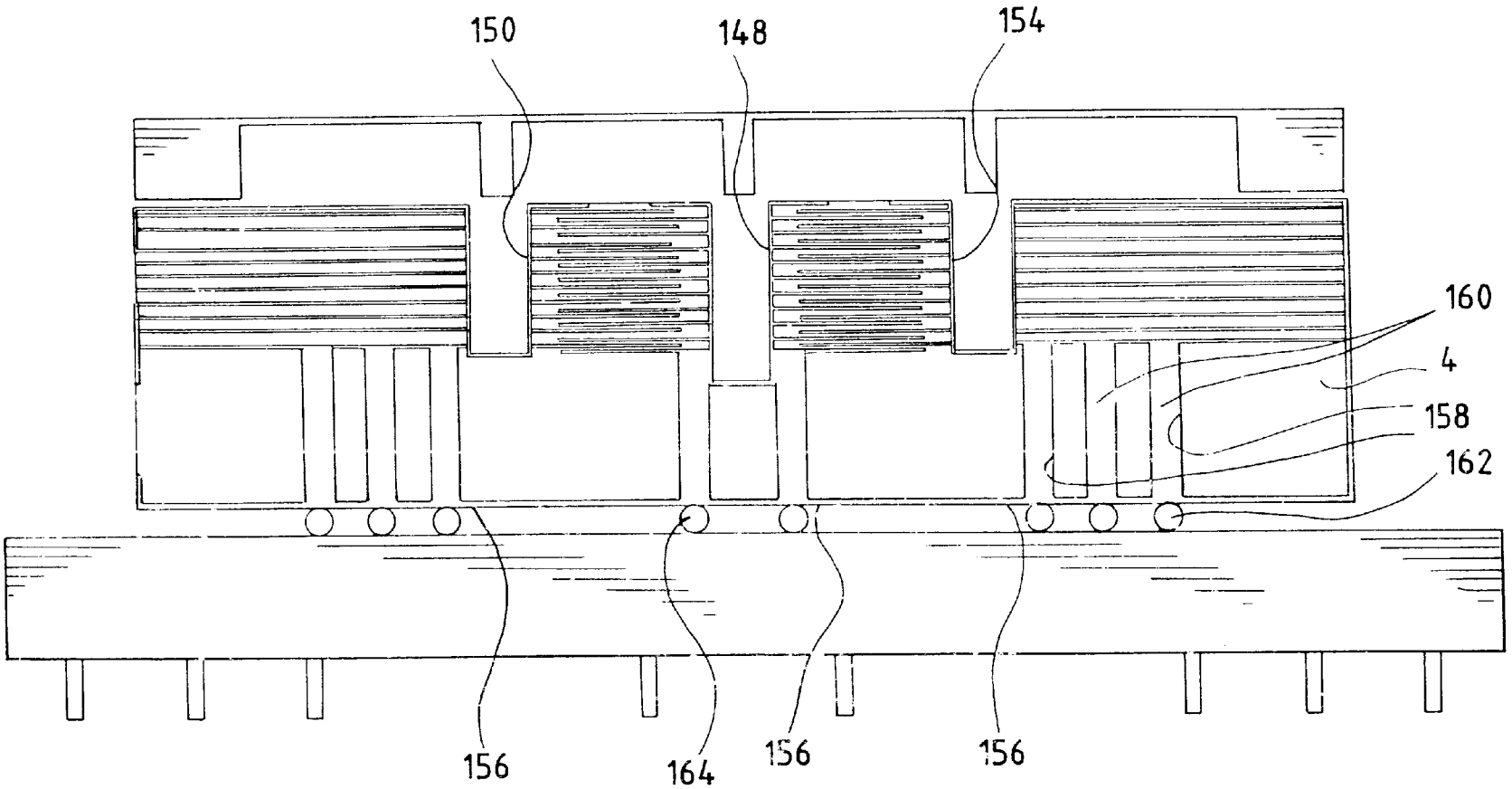
FIG. 12 is a cross-sectional schematic illustration of another embodiment of the electrode and connection pattern, in which with electrode access is from the bottom of the piezo-electric actuator.

Referring briefly to FIGS. 8 and 11–12, it can be seen that the conductive layers 10 are interposed with the piezo-electric material 8. The layers 10 are interposed in the material 8 in a staggered manner. That is, there are two distinct layering patterns that alternate with one another. In such an arrangement, the layers 10 do not extend fully across the transverse direction of the material 8. For example, as shown in FIG. 1, layers 10*a,c,e* do not extend fully across the material 8; rather, the layers 10*a,c,e* are each disposed to form a central gap, as indicated at 11*a,c,e*. The alternating or intermediate layers 10*b,d* are disposed centrally (that is, not extending to the ends of the material 8), and each form gaps, as indicated at 11*b,d*, adjacent the sides of the layers 10*b,d*, thus, "staggering" the layers. These gaps 11*a,b,c,d,e*, . . . are formed so that, as will be described below, when the electrodes are formed, the electrodes are electrically isolated from one another.

As will be readily understood and appreciated by those skilled in the art from a study of the figures, the gaps 11*a,b,e* are at a first longitudinal position, as indicated by the arrow at 15, and the gaps 11*b,d* are at second longitudinal positions as indicated by the arrows at 17, which position is different than the position 15.

Referring now to FIG. 2, it is seen that the multilayer structure 6 is cut to expose the conductive layers 10. The cutting is preferably accomplished with a first deep cut 12 that extends through the entire multilayer structure 6 and into the top surface of the base 4. Second and third cuts 14, 16, respectively, are made on either side of the deep cut 12. The second and third cuts 14, 16 extend through a portion of the multilayer structure 6 but do not extend into the base 4. As a result of these cuts 12, 14 and 16, there are two distinct columns 18 and 20 of piezo-electric material 8 having embedded conductive layers 10 disposed on either side of the deep cut 12.

The columns 18, 20 on either side of and nearest to the deep cut 12 are referred to hereafter as the actuation columns. The outermost columns 24, 26 in relation to the deep cut 12 provide mechanical support. These columns 24, 26 are referred to hereafter as the support columns.

Figure 3A:
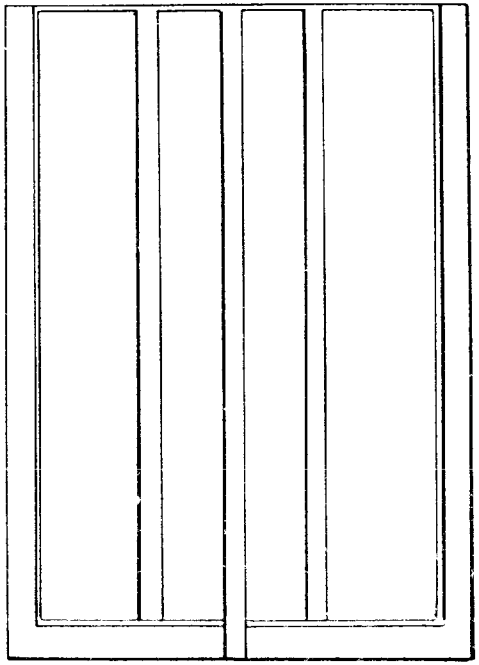
FIG. 3 illustrates a top view and a cross-sectional view of the ceramic block after it has been plated with a conductive metal coating.
Figure 3B:
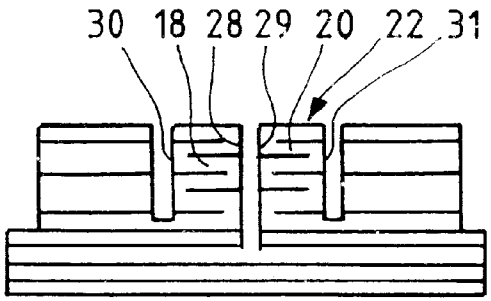

Referring now to FIG. 3, it is seen that the actuation columns 18, 20 are plated with a conductive layer 22. The conductive layer 22 along the side surfaces of each actuation column 18, 20 acts as a first electrode 28 and a second electrode 30. The electrodes nearest the deep cut, hereafter referred to as the inner electrodes 28, 29 share a common charge. The outer electrodes 30, 31 are oppositely charged from the inner electrodes 28, 29. In a preferred arrangement, the inner electrodes 28, 29 are negatively charged and act as a ground. The outer electrodes 30, 31 are positively charged.

Figure 4B:
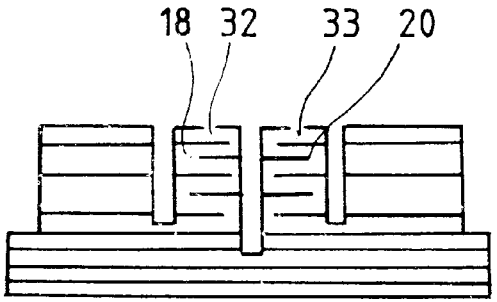

Referring now to FIG. 4, it is seen that a shallow cut 32, 33 is then made in the top surface of each actuation column 18, 20. These shallow cuts 32, 33 separate the inner and outer electrodes of each actuation column.

Figure 5:
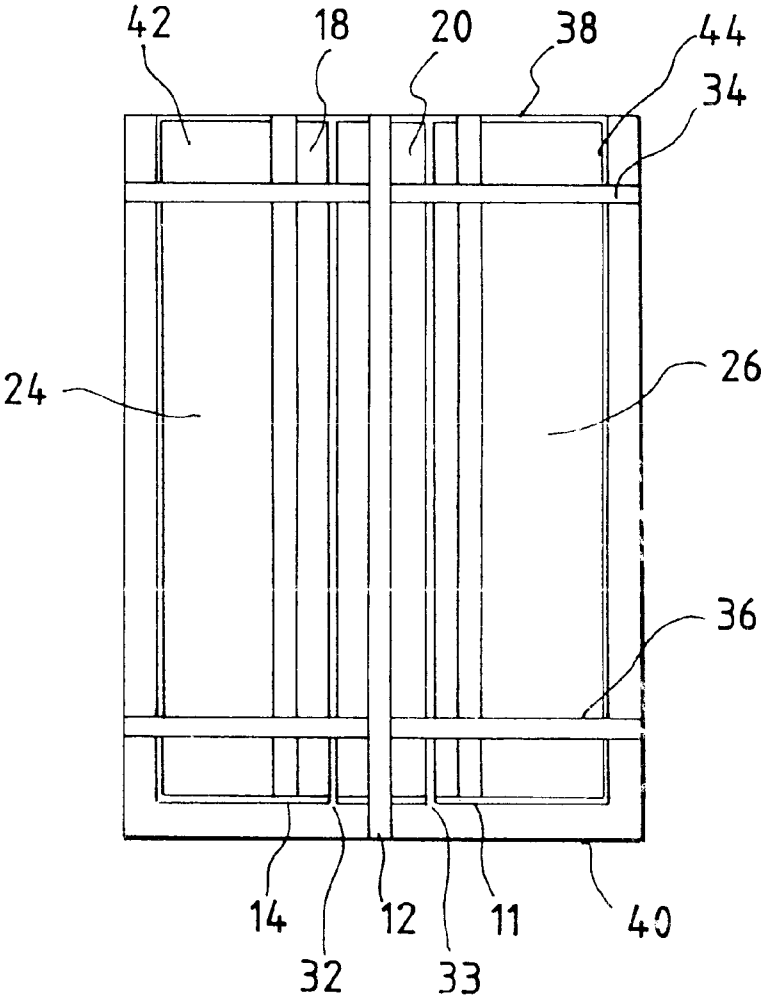
FIG. 5 illustrates a top view of the ceramic block after additional cuts have been made transverse to the shallow cuts, which transverse cuts separate the actuation columns from the supporting pillars.

As can be seen in FIG. 5, two additional cuts 34, 36 are then made, which are transverse, and preferably perpendicular to the earlier cuts. These transverse cuts 34, 36 are made near each end 38, 40 of the block 2 and extend through the actuation columns 18, 20 and the support columns 24, 26 to define supporting pillars 42, 44 at each end 38, 40 of the block 2.

Figure 6:
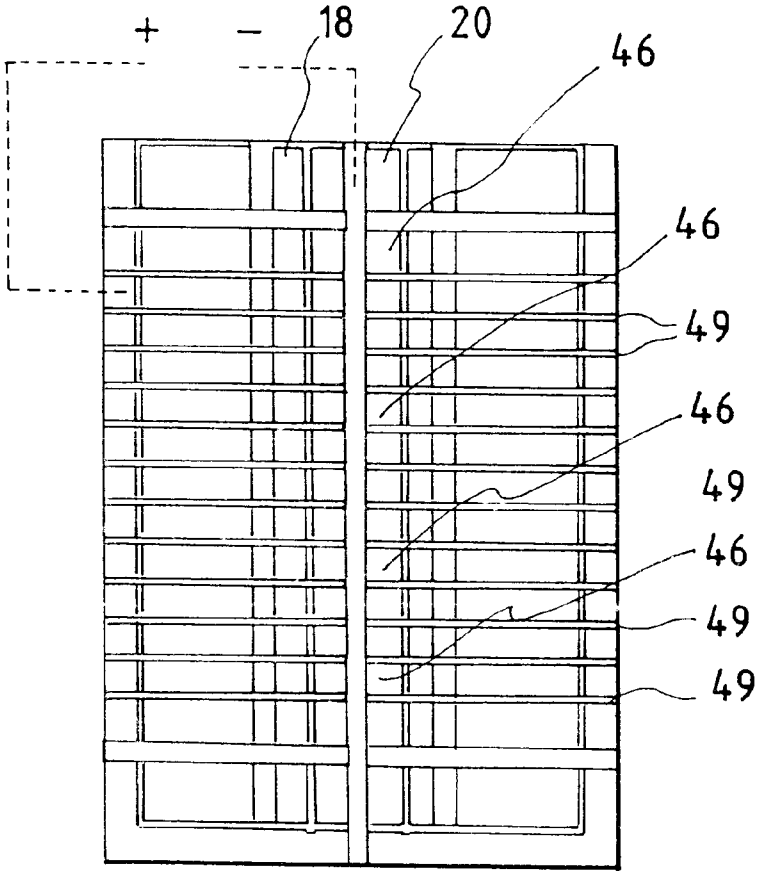
FIG. 6 illustrates a top view of the ceramic block following singulation of the individual actuators.

Referring to FIG. 6, the block 2 is then polarized by exposing the block 2 to a voltage applied normal to the individual layered piezo-electric 8 and metallic elements 10.

Figure 7:
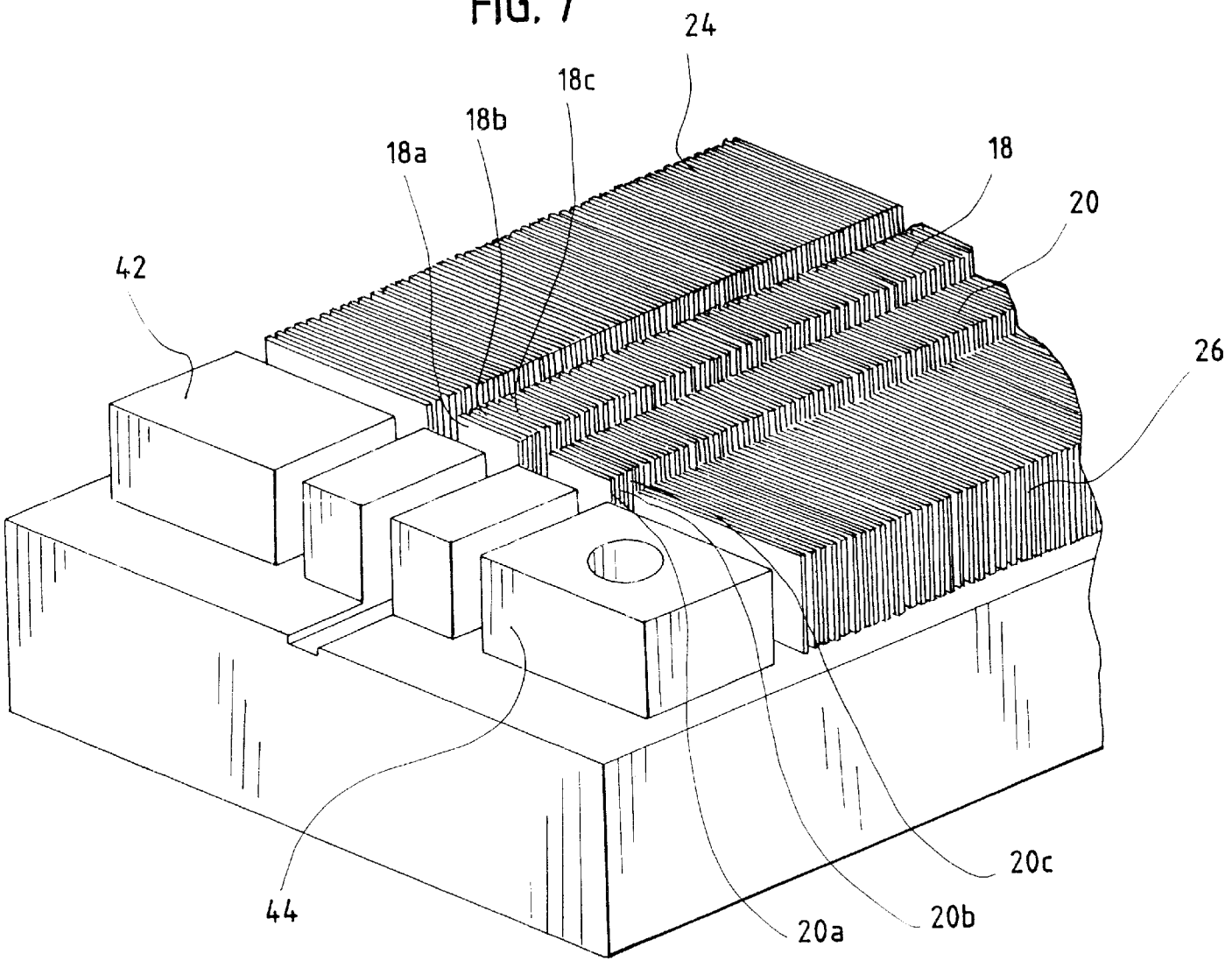
FIG. 7 is a perspective illustration, showing, schematically, the printhead actuator array.

Referring still to FIG. 6, it is seen that a singulation step follows, in which the actuation columns 18, 20 are diced into individual actuator elements 46 by transverse cuts indicated generally at 49. A perspective view of the parallel arrays of individual actuators is shown in FIG. 7. As seen in FIG. 7, the actuation columns 18, 20 are diced into individual actuators 18*a, b, c*, . . . and 20*a, b, c*, . . . disposed in parallel columnar arrays. In this arrangement, the support columns 24, 26 are located on either side of the actuator arrays, with the support pillars 42, 44 located at the end of the arrays.

It is important to note that in the singulation step, that is, in forming the singulated actuators, the depth of the cuts between the individual actuators must be precisely controlled. More specifically, the transverse cuts 49 are deeper than the second and third cuts 14, 16, but are shallower than the deep cut 12. In this manner, the conductive layer 22 in the channels defined by the second and third cuts 14, 16 is cut, but the conductive layer 22 within the channel defined by the deep cut 12 is not cut. As such, the conductive layer 22 within the deep cut 12 channel is formed as a common electrode, whereas the conductive layer 22 in the second and third cut 14, 16 channels is "singulated" to form individual actuators 18*a,b,c,d* . . . and 20*a,b,c,d* . . . .

A cross-sectional view of the printhead arrangement is illustrated in FIG. 8, in which it can be seen that a first piezo-electric actuator 45 is located parallel to a second actuator 47. The actuators 45, 47 have a shared inner electrode 48 disposed between them, and a first control electrode 50 disposed on an outside surface 52 of the first piezo-electric actuator 45 and a second control electrode 54 disposed on an outside surface 56 of the second piezo-electric actuator 47. In a preferred arrangement, the shared inner electrode 48 is negatively charged and acts as a ground. As set forth above, because the conductive layer 22 is not cut (during dicing) within the channel formed by the deep cut 12, the inner electrode 48 is a common electrode. The control electrodes 50, 54 are positively charged and can be connected to control circuitry. Also as set forth above, because the conductive layer 22 is cut (during dicing), within the second and third channel cuts 14, 16 the control or central electrodes 50, 54 are each individually controlled. The transverse cuts 49 are shown in this figure in phantom lines for perspective and understanding relative to the deep cut 12 and the (shallower) second and third cuts 14 and 16.

Figure 9:
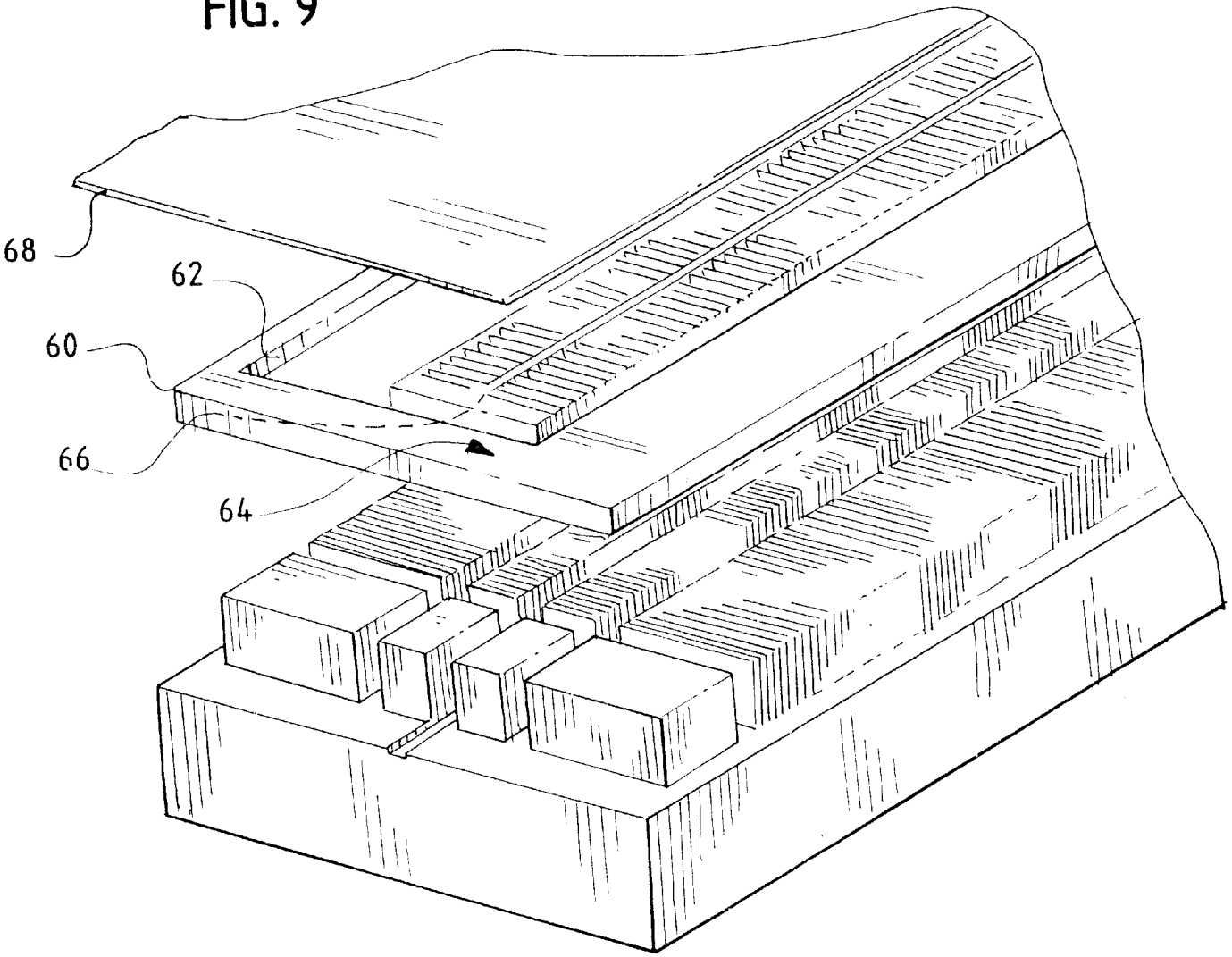
FIG. 9 illustrates a printhead assembly, showing a separate orifice plate.

Referring now to FIG. 9, it is seen that the finished printhead also can include a flexible ink chamber 60, also referred to as a chamber plate. The exemplary chamber plate 60 has an ink chamber 62 and ink manifold 64. The chamber plate 60 and a diaphram 66 is located above and in communication with the piezo-electric actuators. Ink is expelled through a particular orifice hole 69 (see FIG. 10), located at the top of the chamber plate 60, when a signal is delivered by control circuitry to the piezo-electric actuator disposed beneath the particular orifice 69. As seen in FIG. 9, an orifice plate 68 can either be separate from the chamber plate 60, or, as shown in FIG. 10, integrated therewith.

Figure 10:
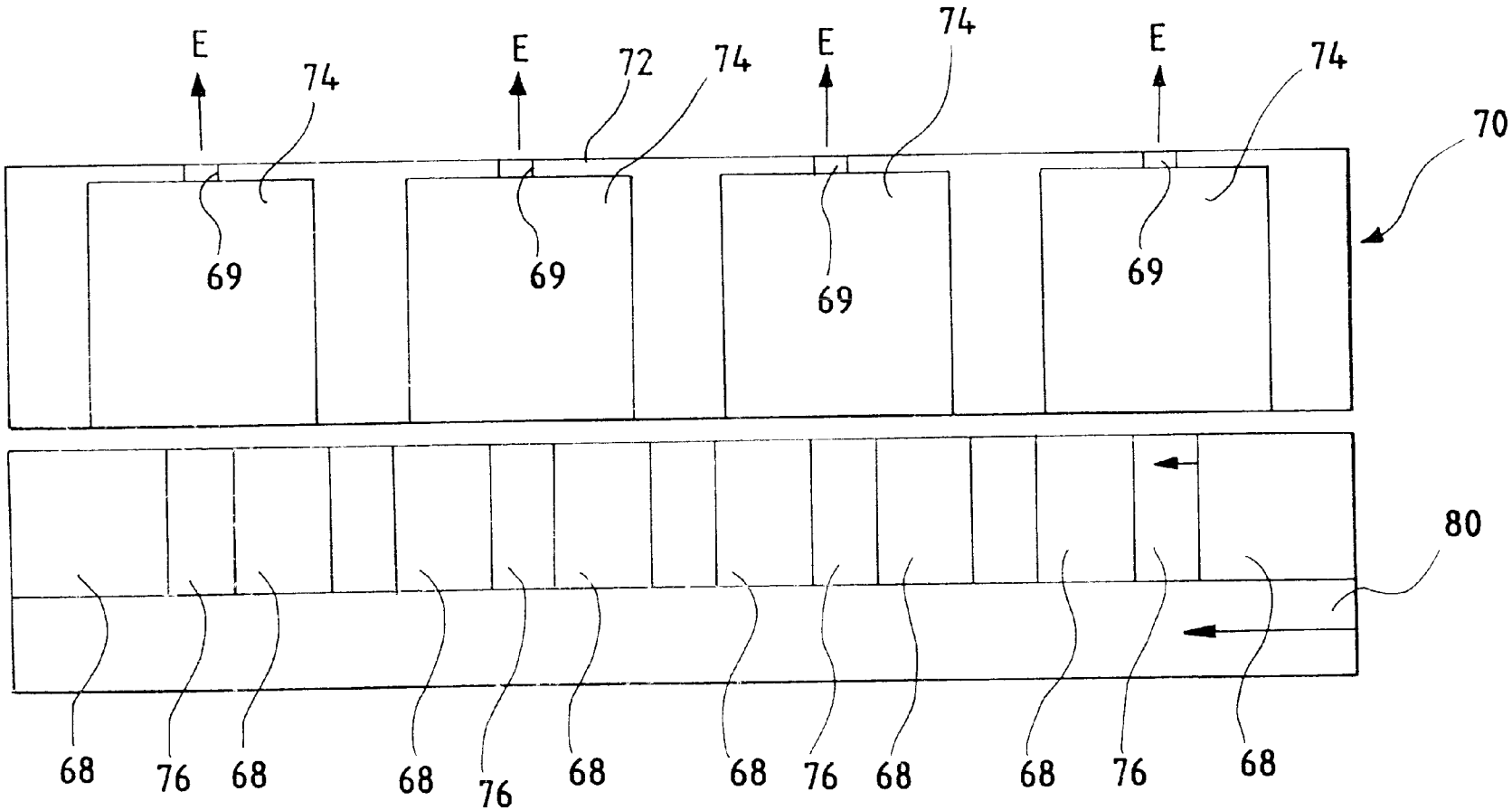
FIG. 10 illustrates a printhead assembly having an integrated orifice plate.

Referring now to FIG. 10, it is seen that the chamber plate 70 with integrated orifice plate 72 includes an ink manifold 74 disposed above and in communication with an array of piezo-electric actuators 76. A polymer 68 is disposed between each actuator 76. The actuators 76 are disposed on a base plate 80.

Referring now to FIG. 11, it is seen that through the shared inner electrode 48 arrangement, printhead space is conserved and access to the actuators 45, 47 is simplified. The outer electrodes 50, 54 are readily accessible from the side for connection control circuitry to supply a signal to control actuation.

In an alternate embodiment, as shown in FIG. 12, the electrodes 148, 150, 154 are accessed from the bottom, as indicated at 156, rather than from the side. In this arrangement, vias 158 are cut into the ceramic base 4. The vias 158 are filled with a metal paste 160 using, for example, a screen printing process that is similar to that used in semiconductor processing, which exemplary screening printing process will be recognized by those skilled in the art. Signal pins 162 disposed under the base 4 are connected to the conductive vias 158, which carry the signal to the piezo-electric layers. Common ground pins 164 also disposed under the base 4 are connected through the conductive vias to the inner electrodes of the actuation columns.

Those skilled in the art will recognize that the vias 158 can be formed in the base material 4 at various times and at various points in the overall piezo-electric actuator manufacturing process. For example, the base material 4 can be formed from a plurality of layers and the vias 158 can be formed in the layers as they are "built-up" to form the base 4. Alternately, the vias 158 can be "cut" in the formed base 4 material. Various other methods and techniques for forming the vias 158 will be recognized and appreciated by those skilled in the art, which other methods and techniques are within the scope and spirit of the present invention.

This bottom access 156 approach allows for a more compact printhead design and simplified manufacturing. It also allows for additional columns of actuator arrays which can provide increased print density.

As will be understood from a study of the figures and the above description, regardless of the connection arrangement, the layer portions 10*a*, 10*c*, . . . form a portion of (or are electrically connected to) electrode 50, while layer portions 10*b*, 10*d* . . . form a portion of (or are electrically connected to) electrode 48. And, as will be understood by reference to FIG. 10, the direction of drop ejection from the printhead is as indicated by the arrows at E. Thus, the direction of drop ejection E is parallel to the direction of the electric field applied to the piezo-electric actuator, and as such, the printhead operates in a D33 mode.

From the foregoing it will be observed that numerous modifications and variations can be effectuated without departing from the true spirit and scope of the novel concepts of the present invention. It is to be understood that no limitation with respect to the specific embodiments and methods illustrated and described is intended or should be inferred. The disclosure is intended to cover by the appended claims all such modifications as fall within the scope of the claims.

What is claimed is:

1. A piezo-electric printhead comprising:

a first piezo-electric actuator disposed parallel to a second piezo-electric actuator, the first and second piezo-electric actuators being disposed on a base and having a shared inner electrode disposed between them, a first control electrode disposed on an outside surface of the first piezo-electric actuator and a second control electrode disposed on an outside surface of the second piezo-electric actuator, each the first and second piezo-electric actuators being formed from an array of actuators arranged in first and second columns, the first and second columns being parallel to one another and separated from one another by a first dice formed to a first depth, each of the actuators of the first array and each of the actuators of the second array being separated from other actuators of that array by a second dice formed to a second depth different from the first depth, and formed transverse to the first dice.

2. The piezo-electric printhead in accordance with claim 1 wherein the shared electrode is a ground.

3. The piezo-electric printhead in accordance with claim 2 wherein the control electrodes are connected to control circuitry.

4. The piezo-electric printhead in accordance with claim 1 wherein the first and second piezo-electric actuators are formed from a multi-layer structure.

5. The piezo-electric printhead in accordance with claim 4 wherein the multi-layer structure is a piezo-electric material having interposed conductive layers.

6. The piezo-electric printhead in accordance with claim 5 wherein the interposed conductive layers are parallel to and spaced from one another.

7. The piezo-electric printhead in accordance with claim 5 wherein the interposed conductive layers are disposed within the piezo-electric material in at least two distinct, alternating patterns, wherein a first pattern is disposed to define at least a first gap at a first longitudinal position and wherein a second pattern is disposed to form at least a second gap at a second longitudinal position different from the first longitudinal position, such that the conductive layers of the first pattern are electrically connected to the first control electrode and the conductive layers of the second pattern are electrically connected to the second control electrode.

8. A piezo-electric printhead comprising:

a piezo-electric actuator fabricated from a single ceramic block, the block having a ceramic base disposed beneath a multilayer structure with alternating piezo-electric and conductive layers;

a positively charged electrode disposed on a first face of the piezo-electric actuator and a negatively charged electrode disposed on a second face of the piezo-electric actuator; and control circuitry connected to the electrodes through conductive vias in the base of the block.

9. The piezo-electric printhead in accordance with claim 8 wherein the piezo-electric actuator comprises an array of piezo-electric actuators.

10. The piezo-electric printhead in accordance with claim 8 wherein the piezo-electric actuator is a first piezo-electric actuator and including a second piezo-electric actuator, the second piezo-electric actuator being fabricated from a single ceramic block, the block having a ceramic base disposed beneath a multilayer structure with alternating piezo-electric and conductive layers, the second piezo-electric actuator including a positively charged electrode disposed on a first face thereof and a negatively charged electrode disposed on a second face thereof, wherein the positively charged electrode or the negatively charged electrode of the first and second piezo-electric actuators is a shared electrode.

11. The piezo-electric printhead in accordance with claim 8 wherein the first and second piezo-electric actuators are each formed from an array of piezo-electric actuators disposed in a column, and defining first and second columns, and wherein the first and second columns are parallel to and spaced from one another.

12. The piezo-electric printhead in accordance with claim 10 wherein the shared electrode is a ground.

13. The piezo-electric printhead in accordance with claim 8 wherein the first and second piezo-electric actuators are formed from a multi-layer structure.

14. The piezo-electric printhead in accordance with claim 13 wherein the multi-layer structure is a piezo-electric material having interposed conductive layers.

15. The piezo-electric printhead in accordance with claim 15 wherein the interposed conductive layers are parallel to and spaced from one another.

16. The piezo-electric printhead in accordance with claim 15 wherein the interposed conductive layers are disposed within the piezo-electric material in at least two distinct, alternating patterns, wherein a first pattern is disposed to define at least a first gap at a first longitudinal position and wherein a second pattern is disposed to form at least a second gap at a second longitudinal position different from the first longitudinal position, such that the conductive layers of the first pattern are electrically connected to the first control electrode and the conductive layers of the second pattern are electrically connected to the second control electrode.

17. A method of controlling a piezo-electric actuator comprising the steps of:

connecting control circuitry to a piezo-electric actuator through a conductive via disposed beneath the actuator; and supplying a signal from the control circuitry to the piezo-electric actuator, the signal travelling through the conductive via to a control electrode in contact with the actuator.

18. The method in accordance with claim 17, wherein the piezo-electric actuator operates in a direct mode.

* * * * *